US005680826A

United States Patent [19]

Nagahama et al.

[11] Patent Number: 5,680,826

[45] Date of Patent: Oct. 28, 1997

[54] SHOE-WIPING MAT FOR RENT

[75] Inventors: Yuji Nagahama; Kazushi Sumimoto; Junji Taguchi, all of Suita, Japan

[73] Assignee: Duskin Co., Ltd., Japan

[21] Appl. No.: 527,136

[22] Filed: Sep. 12, 1995

[51] Int. Cl.[6] ..... D05C 17/00

[52] U.S. Cl. ..... 112/410; 428/85

[58] Field of Search ..... 112/410, 412, 112/411, 413, 415, 9, 7, 2.2, 80.54, 475.23, 80.31, 80.41; 428/85, 88, 89, 92; 15/215, 217

[56] References Cited

U.S. PATENT DOCUMENTS

| | | | |
|---|---|---|---|
| 4,010,303 | 3/1977 | Ramsauer et al. | 428/95 |
| 4,119,049 | 10/1978 | Puckett | 112/475.23 |
| 4,659,602 | 4/1987 | Birch | 428/89 X |
| 4,808,459 | 2/1989 | Smith et al. | 428/97 X |
| 4,974,874 | 1/1989 | Slattery | 112/475.23 |
| 5,205,233 | 4/1993 | Ingram | 112/475.23 |

FOREIGN PATENT DOCUMENTS 0466308 1/1992 European Pat. Off. .

OTHER PUBLICATIONS

Patent Abstracts of Japan vol. 014 No. 363 7 Aug. 1990.
Patent Abstracts of Japan vol. 014 No. 133 6 Apr. 1992.
Patent Abstracts of Japan vol. 016 No. 548 18 Nov. 1992.

*Primary Examiner*—Ismael Izaguirre
*Attorney, Agent, or Firm*—Robbins, Berliner & Carson

[57] ABSTRACT

A shoe wiping mat with color pattern for rent, having a novel taffeted texture and vivid color pattern, excellent softness, dust-adsorbing property and dust-holding property, preventing undulation phenomenon on the mat surface even after repetitive use, and having excellent fitness to floor surfaces, resulting from the tilt of the stitches, zig-zag shape stitches and boundary lines, pitch of the stitches and position thereof.

12 Claims, 3 Drawing Sheets

SHOE-WIPING MAT FOR RENT

BACKGROUND OF THE INVENTION

1. Field of the Invention

The present invention relates to a shoe-wiping mat with color pattern for rent, having a novel taffeted texture. More specifically, the invention relates to a shoe-wiping mat with color pattern for rent, having vivid color pattern, excellent softness, dust-adsorbing property and dust-holding property, preventing undulation phenomenon on the mat surface even after used repetitively, and having excellent fitness to the floor surfaces.

2. Description of the Prior Art

Dust-control (shoe-wiping) mats have heretofore been widely used for preventing outdoor dust and dirt from entering into indoors adhering to the bottoms of the shoes. The dust-control mats are used on a rental basis; i.e., the mats are rented to a customer for a predetermined period of time, laid on a place such as porch through where people go in and out, recovered, washed, regenerated by the treatment with an oil or the like, and are rented again to the customers.

The rental mats include those of the separate type in which a mat with piles is detachably attached to a rubber frame-like base as disclosed in Japanese Patent Publication No. 7450/1984 and those of the unitary type in which a rubber sheet is fastened to the back side of the piled mat as disclosed in Japanese Patent Publication No. 7 213/1992. The latter mats, however, are now preferred owing to their stability when they are laid and appearance.

The shoe-wiping mats are used being laid on entrances of shops, hotels and offices. It has therefore been desired to provide shoe-wiping mats that draw attention and are fashionable, and there have been used shoe-wiping mats having color patterns using taffeta piles of a plurality of hues as taffeta.

The shoe-wiping mats with color pattern for rent have heretofore been produced by using taffeta piles of a plurality of hues and taffeting the base fabric by using such a device as MOQUETTE or WILTON. Of the plurality of colored pile yarns, those pile yarns that do not appear as piles on the surface necessarily exist as dead yarns. Therefore, the pile yarns are used wastefully, resulting in an increase in the cost of the mat and in the weight of the mat.

What is more important is that in the mats of this type in which dead yarns exist on the back surface (stitch surface) of the base fabric, the back surface becomes rugged to a conspicuous degree impairing smoothness. Besides, if it is attempted to improve fitness to the floor surface, the thickness of the backing of the elastomer must be increased.

Moreover, since the back surface of the base fabric has a nonhomogeneous texture and structure, the shoe-wiping mat with color pattern for rent is distorted and is undulated after it is used, washed and is regenerated repetitively. That is, the rental mat loses its commercial value, comfort for walking on it and dust-removing property.

That is, it would appear that the undulation disappears when the adhesion between the base fabric and the rubber is reinforced. In fact, however, the taffeted base fabric and the rubber sheet have radically different chemical compositions and physical properties. Therefore, dimensional difference easily occurs during the production, use or regeneration, and any inhomogeneity in the taffeted base fabric becomes a cause of undulation.

For instance, when the rubber sheet is heat melt-adhered to the base fabric of mat, the rubber sheet is elongated by the heat and then undergoes the contraction by the amount by which it is elongated after the production. Accordingly, a dimensional difference occurs between the two and turns out to be undulation. When washed, furthermore, the rubber does not contract but the base fabric contracts to develop a dimensional difference which is a cause of undulation. The dimensional difference similarly occurs even under the conditions in which it is used where the heat, light, vapor and water are acting thereto.

SUMMARY OF THE INVENTION

The object of the present invention therefore is to provide a shoe-wiping mat with color pattern for rent, having a novel taffeted texture and, particularly, to provide a shoe-wiping mat with color pattern for rent, having vivid color pattern, excellent softness, dust-adsorbing property and dust-holding property, preventing undulation phenomenon on the mat surface even after it is used repetitively, and having excellent fitness to the floor surfaces. According to the present invention, there is provided a shoe-wiping mat for rent comprising a base fabric, mat piles taffeted to the base fabric, and an elastomer backing applied to the non-pile surface of the base fabric, wherein a row of taffeta stitches in the direction of width of the base fabric is slightly tilted relative to the direction of width of the base fabric and is formed in a zig-zag shape from a folding point on one side to a folding point on the other side maintaining a predetermined distance in the direction of width and a small distance in the lengthwise direction, thereby to form a belt-like row of taffeta stitches which as a whole extends in the lengthwise direction of the base fabric, boundary lines connecting the folding points which are neighboring in the lengthwise direction of taffeta stitches are formed in a zig-zag shape having a pitch greater than the pitch between said folding points, the folding points of the belt-like row of taffeta stitches neighboring in the direction of width of the base fabric are positioned on common zig-zag boundary lines, the folding points of the belt-like row of one side are positioned at the centers of the folding points which are neighboring in the lengthwise direction of the belt-like row of the other side, mat piles have a plurality of mat pile surfaces of different hues the mat piles do not at all have dead yarns, and at least one unstitched portion exists between the neighboring mat pile surfaces of different hues.

In the shoe-wiping mat of the present invention, it is desired that the rows of taffeta stitches that are neighboring in the lengthwise direction are so formed as to have different sizes in order to form zig-zag boundary lines, and that an average width (W) between the folding points of taffeta stitches in the direction of width of the base fabric is from 10 to 200 mm and, particularly, from 20 to 80 mm, that the pitch (Ps) between the folding points in the lengthwise direction is from 1 to 30 mm and, particularly, from 3 to 20 mm, and that the size of deviation (Ws) in the direction of width is from 1 to 40 mm and, particularly, from 2 to 16 mm. It is further desired that the size of protrusion (Z) of the zig-zag boundary lines in the direction of width of the base fabric is from 1 to 40 mm and, particularly, from 5 to 25 mm, and the pitch in the lengthwise direction (Pz) is from 10 to 100 mm and, particularly, from 20 to 80 mm.

The shoe-wiping mat with color pattern for rent of the present invention comprises the base fabric, mat piles taffeted to the base fabric, and the elastomer backing applied to the non-pile surface of the base fabric, and a first feature resides in the double rows of taffeta stitches of the base fabric, that are forming a particular zig-zag structure.

That is, in the mat of the present invention, a row of taffeta stitches is slightly tilted relative to the direction of width of the base fabric and is formed in a relatively small zig-zag shape from a folding point on one side to a folding point on the other side maintaining a predetermined distance in the direction of width and a small distance in the lengthwise direction, thereby to form a belt-like row of taffeta stitches which as a whole extends in the lengthwise direction of the base fabric, and boundary lines connecting the folding points which are neighboring in the lengthwise direction of taffeta stitches are formed in a zig-zag shape having a pitch greater than the pitch between said folding points creating the double zig-zag structure.

To explain the arrangement and size of the double zig-zag structure of taffeta stitches of the present invention, FIG. 3 illustrates a basic recurring unit of the rows of taffeta stitches, and wherein X represents the direction of width and Y represents the lengthwise direction.

First, the stitches consist of unit rows 10*a* and 10*b* which are continuous in series maintaining a small distance. The unit row 10*a*(10*b*) is slightly tilted in the direction X of width of the base fabric, and is formed in a zig-zag shape from a folding point 11*a*(12*a*) on one side to a folding point 12*a*(12*b*) on the other side maintaining a predetermined distance (W+Ws/2; W is an average size in the direction of width and Ws is a size of deviation of small zig-zag shape in the direction of width) in the direction X of width and maintaining a small distance (Ps/2; Ps is a pitch of small zig-zag shape in the lengthwise direction) in the lengthwise direction, forming a belt-like row 13A of taffeta stitches which, as a whole, extends in the lengthwise direction of the base fabric.

Boundary lines 14(15) connecting the neighboring folding points 11*a*, 11*b*, 11*c*, . . . (12*a*, 12*b*, 12*c*, . . . ) of taffeta stitches in the lengthwise direction are forming zig-zag boundary lines having a pitch Pz in the lengthwise direction which is greater than the pitch Ps between the folding points in the lengthwise direction and having a size of protrusion Z in the direction of width. That is, the unit row 10*a* of taffeta stitches is longer than the unit row 10*b*, which gives a size of deviation Ws of a small zig-zag shape and, consequently, gives the pitch Pz of a large zig-zag shape in the lengthwise direction and the size of protrusion Z in the direction of width.

A dimensional relationship of unit rows 10*a* and 10*b* of taffeta stitches is inverted at given folding points. The inverting positions, i.e., the folding positions of the large zig-zag shape 14 are n-th positions as counted from the start point, where n is a number satisfying the following formulas (1) and (2), $$n=Z/Ws \quad (1)$$

$$n=Pz/2Ps \quad (2)$$

In the embodiment shown in FIG. 3, the folding point 11*d* corresponds thereto.

The belt-like row 13A of taffeta stitches is formed in a side-by-side relationship in the direction X of base fabric relative to the right and left neighboring belt-like rows 13B and 13C, the folding points of the belt-like rows 13B, 13C of taffeta stitches which are neighboring in the direction X of width of the base fabric are positioned on the common zig-zag boundary lines 14, 15, and the folding points 16*a*, 16*b*, . . . (17*a*, 17*b*, . . . ) of the belt-like rows 13B(13C) of the neighboring sides are positioned at the centers of the neighboring folding points 11*a*, 11*b*, . . . (12*a*, 12*b*, . . . ) in the lengthwise direction of the belt-like row 13A of the side that serves as a reference. That is, the belt-like rows 13A, 13B, 13C of taffeta stitches which are neighboring in the direction X of width of the base fabric are in phase in regard to the pitch Pz of the large zig-zag shape but are out of phase by ½ in regard to the pitch Ps of the small zig-zag shape.

According to the present invention which employs the above-mentioned taffeta stitch texture, the mat is prevented from being deviated when it is laid on the floor and is, further, effectively prevented from developing undulation when it is used, washed and is regenerated repetitively.

The deviation in position of the mat which is a problem in the present invention is a phenomenon in which when people walk treading on the mat laid on the inlet, the mat is slightly deviated in position from where it is laid on the floor surface due to the pressure of when it is trod and the release of pressure. This stems from the fact that the mat piles that are implanted have a directivity. To eliminate such a positional deviation, therefore, it is important to eliminate the directivity of implantation.

The mat of the present invention has taffeta stitches that constitute two large and small zig-zag structures in the lengthwise direction of the base fabric of the mat and, further, constitute wedge-like structure in both directions in the direction of width of the base fabric of the mat. Due to the zig-zag structures and wedge-like structure of the taffeta stitches, therefore, there is obtained a restoring force which prevents the mat from moving in any direction, and the mat is prevented from being deviated in position.

In addition to the combination of the zig-zag structures and wedge-like structure of the taffeta stitches, furthermore, the folding points of the belt-like rows of taffeta stitches that are neighboring in the direction of width of the base fabric are positioned on the common zig-zag boundary lines, and the folding points of the belt-like row on one side are located at the centers of the folding points that are neighboring in the lengthwise direction of the belt-like row of the other side, whereby the taffeta stitches exist in a random fashion and uniformly as a whole, the residual stress is dispersed when the mat is used, washed and regenerated repetitively, and occurrence of undulation is effectively prevented.

In the shoe-wiping mat of the present invention, the mat piles have a plurality of mat pile surfaces of different hues to impart its own ornamental effect and fashionableness. Here, a distinguished feature resides in that the mat piles do not at all have dead yarns, and at least one unstitched portion exists between the neighboring mat pile surfaces of different hues.

That is, at least one unstitched portion is present between the neighboring mat pile surfaces of different hues, making it possible to effectively prevent the mat piles of different hues from mixing in the boundary portion of the mat pile surfaces and, hence, to form a vivid and clear pattern on the surface of the mat.

In the shoe-wiping mat of the present invention having a multi-color pattern, furthermore, the mat piles do not include any dead yarn; i.e., the yarns are all used for forming the mat piles. It is therefore made possible to save the amount of the yarns and to uniformalize the texture of mat piles on the upper surface of the base fabric, presenting distinguished effects from the standpoint of softness and the feel of the piles, dust-adsorbing property and dust-holding property, and preventing undulation.

DETAILED DESCRIPTION OF THE INVENTION

Figure 1:
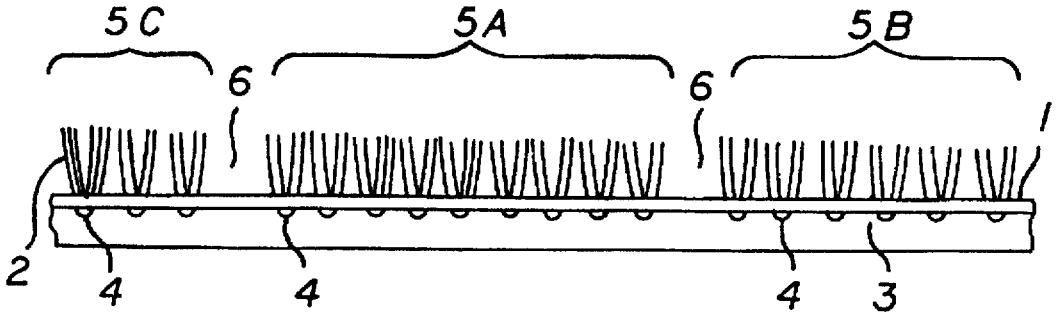
FIG. 1 is a sectional view which schematically illustrates a shoe-wiping mat with color pattern for rent according to the present invention.
Figure 2:
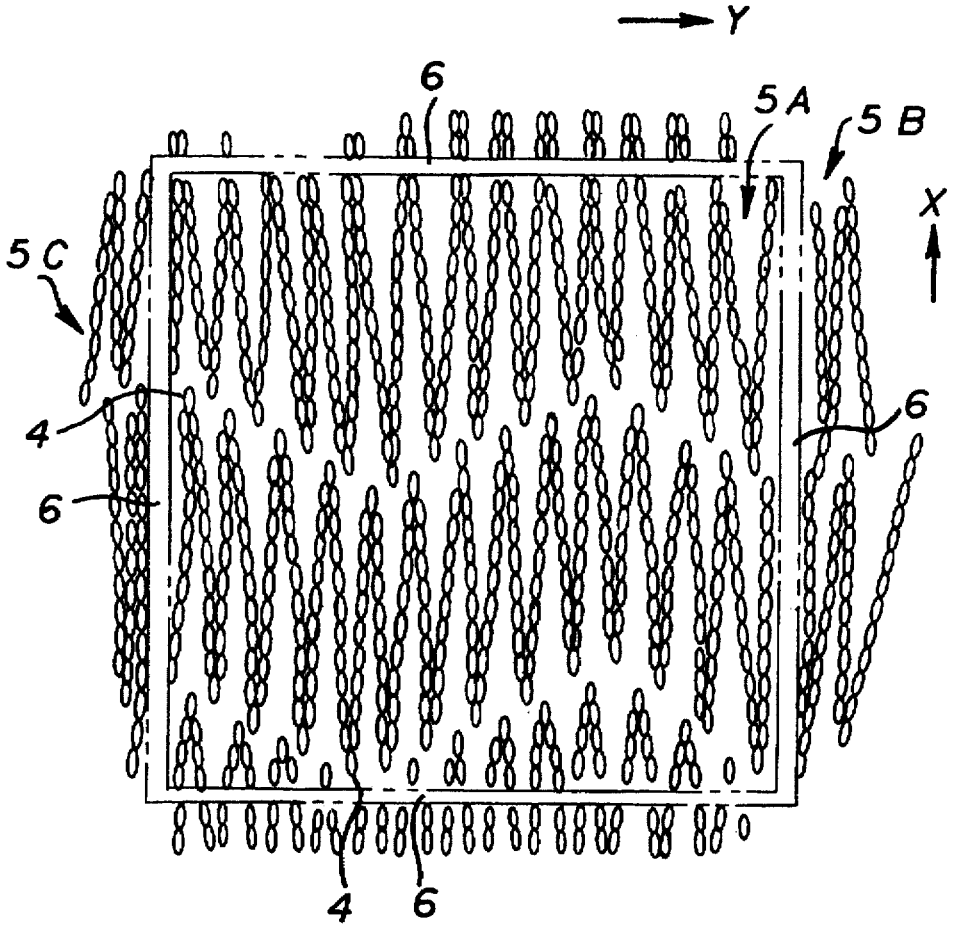
FIG. 2 is a plan view illustrating, on an enlarged scale, the stitched surface of the base fabric of the shoe-wiping mat of the present invention.

FIG. 1 is a sectional view which schematically illustrates the shoe-wiping mat with color pattern for rent according to the present invention, and FIG. 2 is a plan view illustrating, on an enlarged scale, the stitched surface of a base fabric of the mat.

The shoe-wiping mat with color pattern for rent of the present invention comprises a base fabric 1, mat piles 2 taffeted on the base fabric, and an elastomer backing 3 applied to the non-pile surface of the base fabric. Taffeta stitches 4 exist on the back surface of the base fabric 1.

Pile patterns 5*a*, 5*b*, 5*c*, . . . having different hues exist on the mat pile surface of the shoe-wiping mat. At least one unstitched portion 6 exists in the boundary of the pile patterns. According to the present invention, the mat piles 2 are all taffeted to the base fabric 1 at a predetermined driving density, and there exist no dead yarn or yarn that extends in parallel with the base fabric in excess of a predetermined stitch length.

Figure 3:
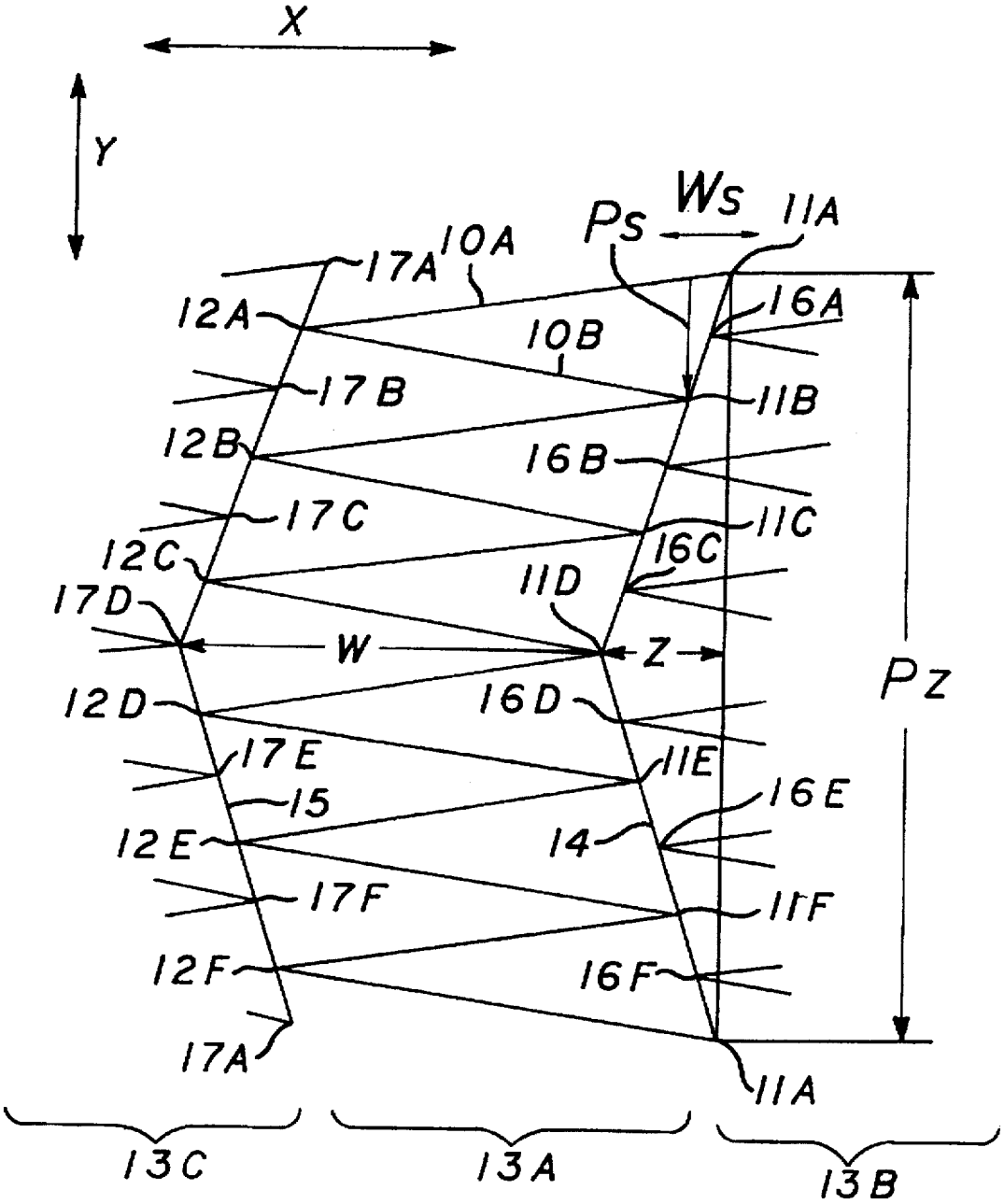
FIG. 3 is a diagram explaining the arrangement and size of a double zig-zag structure of taffeta stitches according to the present invention.

The basic pattern (taffeta stitch texture) of the row of taffeta stitches 4 of FIG. 2 was described in detail with reference to FIG. 3, and it should be noted that the unstitched portion 6 exists between the pile patterns of different hues not only in the direction of width of the base fabric but also in the lengthwise direction of the base fabric.

In the shoe-wiping mat of the present invention, it is desired that the average width (W) between the folding points of the rows 10*a* and 10*b* of taffeta stitches 4 in the direction of width of the base fabric is from 10 to 200 mm and, particularly, from 20 to 80 mm from the standpoint of taffeting the mat piles and of preventing the position deviation and undulation of the mat. From the same point of view and of selecting a proper taffeting density, furthermore, it is desired that the pitch (Ps) between the folding points in the lengthwise direction is from 1 to 30 mm and, particularly, from 3 to 20 mm, and the size of deviation (Ws) in the direction of width is from 1 to 40 mm and, particularly, from 2 to 16 mm.

It is further desired that the size of protrusion (Z) of the zig-zag boundary line in the direction of width of the base fabric is from 1 to 40 mm and, particularly, from 5 to 25 mm and that the pitch (Pz) in the lengthwise direction is from 10 to 100 mm and, particularly, from 20 to 80 mm from the object of the present invention. When Z is smaller than the above-mentioned range or when Pz is larger than the above-mentioned range, only small effect is obtained for preventing the position deviation of the mat and for preventing undulation. In the opposite case, taffeting efficiency decreases.

The shoe-wiping mat of the present invention is taffeted by using an apparatus for producing patterned and taffeted products disclosed in Japanese Laid-Open Patent Publication No. 5014 62/1986 and by controlling the taffeted pattern as described above. In this production apparatus, yarns having different colors are arbitrarily and selectively fed to the opener (taffeting needle) for the base fabric, a taffeting needle is corresponded to each belt-like row, and the taffeting needle is scanned and the yarns are fed in a controlled manner as described above. This control is easily performed by setting a pattern to a control computer in advance.

As the base fabric, there can be used woven fabrics and nonwoven fabrics of a variety of fibers. As the woven fabric, there can be used a plain woven fabric or a modified woven fabric obtained by weaving spun yarns or multi-filament yarns. As the nonwoven fabric, on the other hand, there can be used those of the spun-bonded type, melt-blown type or heat melt-adhered type. The base fabric may be comprised of any synthetic fibers such as polyester fibers, polyamide fibers, acryl fibers or ultra-high molecular polyolefin fibers. Most desirably, however, the base fabric should be comprised of a high molecular thermoplastic polyester and, particularly, a thermoplastic copolyester composed chiefly of polyethylene terephthalate or ethylene terephthalate.

It is desired that the weight of the base fabric is, generally, from 50 to 500 g/m$^2$ and, particularly, from 100 to 400 g/m$^2$ though it may vary depending upon the weight of the mat.

As the base fabric having particularly excellent property for preventing undulation, there can be used a plain woven fabric of flat slit yarns (film yarns) of a drawn polyester film. As the mat piles having excellent erecting property, furthermore, there can be used a base fabric obtained by needle-punching a floss-like synthetic fiber to the plain woven fabric of flat slit yarns of the drawn polyester film. The flat slit yarns are obtained by slitting a forcibly drawn polyester film having a thickness of from 10 to 5000 μm to have a width of from about 2 to about 25 mm. Though the above-mentioned synthetic fibers can be all used as the floss-like synthetic fibers, it is desired to use the polyester fibers. The floss-like fibers are obtained by superposing a fiber web formed by carding or the like on both sides of the woven fabric, and causing the fibers to be entangled by one another. The single fiber may have a thickness of from about 1 to about 20 deniers.

As the pile yarns to be driven into the base fabric, there can be used spun yarns or multi-filament yarns consisting of one or two or more kinds of cotton fibers, rayon fibers, polyvinyl alcohol fibers, acryl fibers, nylon fibers and any other synthetic fibers. It is desired that the mat piles are multi-filament yarns or spun yarns of nylon fibers or acryl fibers. The pile yarns can be implanted, i.e., taffeted by the above-mentioned means. Moreover, the mat pile yarns may be curled or uncurled, and the pile length may be the same or different.

Generally, it is desired that the mat pile yarns have a thickness of from 300 to 10000 deniers/yarn and, particularly, from 1000 to 10000 deniers/yarn, has a number of twists of from 50 to 500 turns/m and, particularly, from 100 to 300 turns/m, and have a pile length of from 3 to 20 mm and, particularly, from 5 to 15 mm. It is further desired that the mat piles are driven into the base fabric in a number of from 3 to 20 piles/inch and, particularly, from 5 to 14 piles/inch (from 1.97 to 5.5 piles/cm).

The shoe-wiping mat of the present invention can be adapted to either a unitary mat that does not require any particular underlay (base) or to a separate mat that requires the underlay. In the former case, the rubber sheet is formed together with the base fabric to for a backing and in the latter case, a rubber latex is applied to form a thin rubber backing layer.

As the rubber that serves as the backing, there can be used a variety of elastomer polymers such as nitrile-butadiene rubber (NBR), styrene-butadiene rubber (SBR), chloroprene rubber (CR), polybutadiene (BR), polyisoprene (IIB), butyl rubber, natural rubber, ethylene-propylene rubber (EPR), ethylene-propylene-diene rubber (EPDM), polyurethane, chlorinated polyethylene, chlorinated polypropylene, soft vinyl chloride resin and the like. From the standpoint of resistance against oils and weatherability, it is desired to use the nitrile-butadiene rubber (NBR). In forming the rubber backing, it is allowed to blend widely known blending agents such as sulfur or organic curing agent, cure promoting agent, softening agent, anti-aging agent, filler, dispersant, plasticizer, coloring agent and the like agents in known amounts.

In forming a mat as a unitary structure, the above-mentioned rubber composition is kneaded using a roll, Bumbury's mixer or the like. The composition is then molded into a sheet and on which is then placed a taffeted mat. The laminate is then heated and pressurized in a pressurizing mold to effect the adhesion and curing simultaneously. To increase the adhesion between the rubber sheet and the base fabric, the non-pile surface of the base fabric may be coated with a rubber latex of the same kind as the rubber sheet. Or, an adhesive agent such as an ethylene acet ate/vinyl copolymer or an adhesion promoting agent may be applied thereto in advance. It is desired that the weight of the rubber sheet lies within a range of from 100 to 3200 g/m$^2$, and the rubber sheet and the base fabric are adhered together as a unitary structure in such a manner that the edges of the rubber sheet slightly protrude outwardly beyond the edges of the base fabric. The adhesion by curing is better carried out at a temperature of from 90° to 200° C. under a pressure of from 0.5 to 10 kg/cm$^2$.

When a soft vinyl chloride resin is used as the rubber sheet, a plastic sol of the vinyl chloride resin is applied to the non-pile surface of the pile-implanted base fabric and, then, the plastic sol layer of the vinyl chloride resin is gelled upon heating. When a polyurethane is used as the rubber sheet, a two-can type polyurethane resin composition is applied to the non-pile surface of the pile-implanted base fabric and is then cured upon heating or the like.

The backing of the separate mat is formed by applying a latex of the above-mentioned elastomer followed by drying or curing. The curing can be effected under normal pressure at the above-mention ed temperature.

It is desired that the elastomer backing has a thickness of, generally, from 0.01 mm to 3 mm and, particularly, from 0.1 to 2.5 mm. When the thickness is relatively as small as 0.5 mm or less, the elastomer backing can be used in combination with the mat base. When the thickness is not smaller than 0.5 mm, the elastomer backing can be used by itself as a unitary mat.

The pile yarns of the mat of the present invention adsorb and hold dust adhered to the bottoms of the shoes. To further enhance this action, the pile yarns may be coated or impregnated with a dust-adsorbing oil. As the dust-adsorbing liquid, there can be used mineral oils such as fluidized paraffin, spindle oil, alkylbenzene oil, diester oil and castor oil, or such oils as synthetic oils or plant oils, or aqueous dust-adsorbing agent as disclosed in Japanese Patent Publications Nos. 1019/1978 and 37471/1978. Usually, the adsorbing agent may be applied in an amount of from 0.1 to 200 g/m$^2$.

EXAMPLES

The invention will now be described in further detail by way of the following Examples.

Example 1

| | | |
|---|---|---|
| BCF nylon: | 9 stitches/inch<br>pile length 9 mm<br>cut pile | gauge 1/10<br>weight 1700 g/m$^2$ |
| Base fabric: | polyester plain<br>woven fabric<br>*polyester cotton | <br>150 g/m$^2$<br>100 g/m$^2$ |
| | | Total 250 g/m$^2$ |

The polyester cotton was punch-worked using a needle.

The samples A and B were prepared by the following driving design.

The samples A and B were so set as to have the same number of taffetas/inch.

Sample A: linear taffetas

Figure 4:
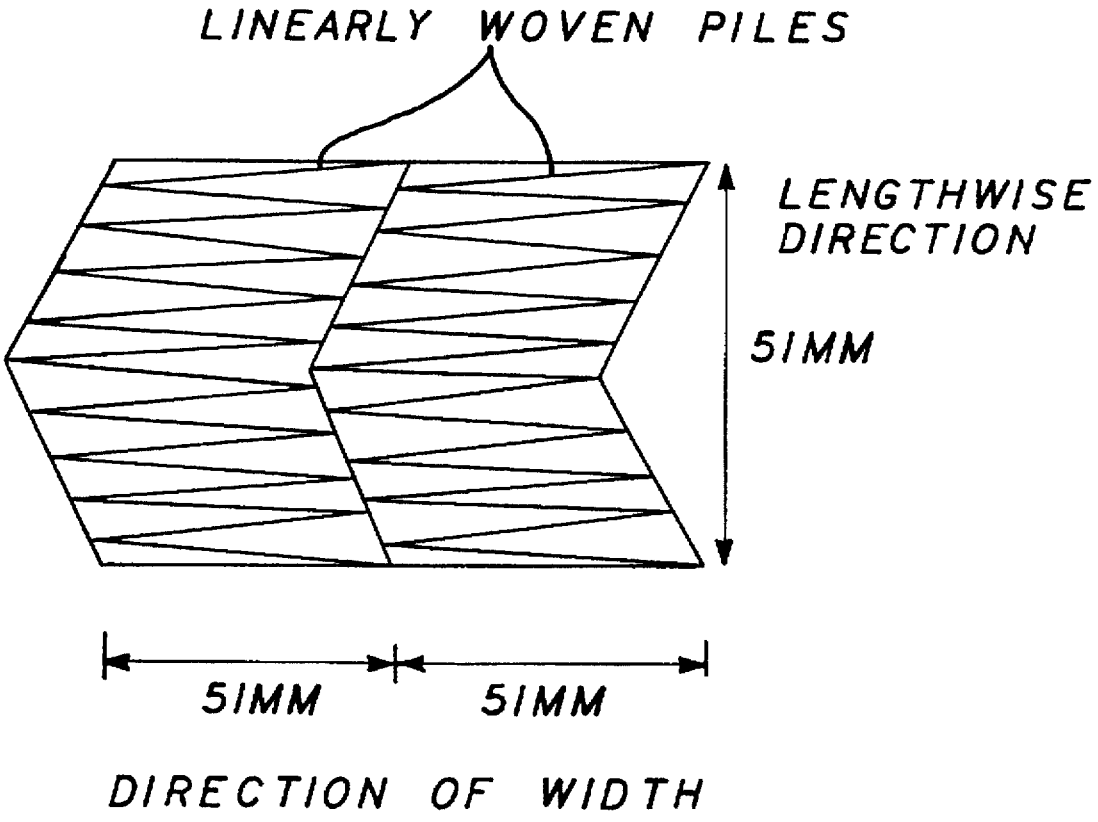
FIG. 4 is a diagram illustrating the structure of taffeta stitches of a sample B used in the example.

Sample B: shown in FIG. 4

The above-mentioned starting fabric was coated with the latex followed by drying at 175° C. for 15 minutes, and was cured together with an uncured rubber sheet that was cut into a size of 70×85 cm having a thickness of 1.8 mm under the conditions of a temperature of 170° C. for 15 minutes under a pressure of 5 kg/cm$^2$.

The mat was laid for three days on a place where 3000 people walk through a day and was then washed. This was repeated 40 times to measure the degree of contraction of the mat and the occurrence of undulation.

TABLE 1

| | Item | A | B |
|---|---|---|---|
| Lengthwise direction | Coefficient of contraction | contracted by 2.8% | 1.3% |
| | Undulation | 10 mm × 5 | 0 |
| Direction of width | Coefficient of contraction | contracted by 1.4% | 1.4% |
| | Undulation | 10 mm × 4 | 0 |

As is obvious from Table 1, the sample A having a linear weaving direction is greatly contracted in the lengthwise direction and the mat as a whole undulated. On the other hand, the sample B uniformly contracted in both the direction of width and lengthwise direction, and was neither locally contracted nor undulated, and could be favorably used.

According to the present invention which employs a particular taffeta stitch texture of a double zig-zag structure, it is allowed to prevent the positional deviation of the mat that is used being laid on the floor, and occurrence of undulation is effectively prevented even when the mat is used, washed and regenerated repetitively.

That is, in the taffeta-stitched mat of the present invention, there exist two large and small zig-zag structures in the lengthwise direction of the base fabric of the mat, and the wedge-like structure exists in both directions in the direction of width of the base fabric of the mat. Due to the zig-zag structure and wedge-like structure of taffeta stitches, therefore, there is obtained a restoring force that prevents the mat from moving in any direction, and the mat is prevented from being deviated in position.

In addition to the combination of the zig-zag structure and the wedge-like structure of taffeta stitches, furthermore, the folding points of the belt-like row of taffeta stitches neighboring in the direction of width of the base fabric are positioned on common zig-zag boundary lines, and the folding points of the belt-like row of one side are positioned at the centers of the folding points which are neighboring in the lengthwise direction of the belt-like row of the other side. Therefore, the taffeta stitches as a whole exist in a random fashion and uniformly, and the residual stress is dispersed when the mat is used, washed and regenerated repetitively, and occurrence of undulation is effectively prevented.

In the shoe-wiping mat of the present invention, furthermore, the mat piles have a plurality of mat pile surfaces of different hues to impart its own ornamental effect and fashionableness. Here, however, the mat piles do not at all include dead yarn, and at least one unstitched portion exists between the neighboring mat pile surfaces having different dues, offering the following distinguished advantages.

That is, with at least one unstitched portion being interposed between the neighboring mat pile surfaces of different hues, the mat piles having different hues are effectively prevented from being mixed in the boundary portion of the mat pile surfaces, and it is allowed to form a vivid and clear pattern on the surface of the mat.

In the shoe-wiping mat having multi-color pattern of the present invention, furthermore, the mat piles do not at all contain dead yarn and the yarns are all used for forming the mat piles, making it possible to save the amount of the yarns, to uniformalize the mat pile texture on the base fabric, and offering distinguished effects in regard to softness and the feel of the piles, dust-adsorbing property, dust-holding property, and preventing undulation.

We claim:

1. A shoe-wiping mat for rent comprising a base fabric, mat piles taffeted a first surface of to the base fabric, and an elastomer backing applied to a second surface of the base fabric opposite said first surface, defining a non-pile surface, wherein a row of taffeta stitches in the direction of width of the base fabric is slightly angled relative to the—direction of width of the base fabric and is formed in a zig-zag shape from a reversing point on one side to a reversing point on the other side maintaining a predetermined distance in the direction of width and a small distance in the lengthwise direction, thereby to form a belt-like row of taffeta stitches which as a whole extends in the lengthwise direction of the base fabric, boundary lines connecting the reversing points which are neighboring in the lengthwise direction of taffeta stitches are formed in a zig-zag shape having a pitch greater than the pitch between said reversing points, the folding points of the belt-like row of taffeta stitches neighboring in the direction of width of the base fabric are positioned on common zig-zag boundary lines, the folding points of the belt-like row of one side are centered between the reversing points which are neighboring in the lengthwise direction of the belt-like row of the other side, mat piles have a plurality of mat pile surfaces of different hues, the mat piles do not at all have dead yarns, and at least one unstitched portion exists between the neighboring mat pile surfaces of different hues.

2. A shoe-wiping mat according to claim 1, wherein rows of taffeta stitches that are neighboring in the lengthwise direction are so provided as to have sizes which are different from each other.

3. A shoe-wiping mat according to claim 2, having a protrusion (Z) of the zig-zag boundary line in the direction of width of the base fabric, said protrusion is from 5 to 25 mm, and a pitch (Pz) in the lengthwise direction is from 20 to 80 mm.

4. A shoe-wiping mat according to claim 1, wherein an average width (W) between the folding points of taffeta stitches in the direction of width of the base fabric is from 20 to 80 mm, a pitch (Ps) between the folding points in the lengthwise direction is from 3 to 20 mm, and a size of deviation (Ws) in the direction of width is from 2 to 16 mm.

5. A shoe-wiping mat according to claim 4, having a protrusion (Z) of the zig-zag boundary line in the direction of width of the base fabric, said protrusion is from 5 to 25 mm, and a pitch (Pz) in the lengthwise direction is from 20 to 80 mm.

6. A shoe-wiping mat according to claim 1, having a protrusion (Z) of the zig-zag boundary line in the direction of width of the base fabric, said protrusion is from 5 to 25 mm, and a pitch (Pz) in the lengthwise direction is from 20 to 80 MM.

7. A shoe-wiping mat according to claim 1, wherein the base fabric comprises a plain woven fabric of flat slit yarns of a drawn polyester film.

8. A shoe-wiping mat according to claim 1, wherein the base fabric is obtained by needle-punching a floss-like synthetic fiber to a plain woven fabric of flat slit yarns of a drawn polyester film.

9. A shoe-wiping mat according to claim 1, wherein the mat piles are nylon fibers, multi-filament yarns of acryl fibers or spun yarns, and have a thickness of from 500 to 5000 deniers, a number of twists of 50 to 300 turns per a meter, and a pile length of from 5 to 30 mm.

10. A shoe-wiping mat according to claim 1, wherein the mat piles are driven into the base fabric in a number of 5 to 15 piles per/inch (1.97 to 5.9 piles/cm).

11. A shoe-wiping mat according to claim 2, wherein an average width (W) between the folding points of taffeta stitches in the direction of width of the base fabric is from 20 to 80 mm, a pitch (Ps) between the folding points in the lengthwise direction is from 3 to 20 mm, and a size of deviation (Ws) in the direction of width is from 2 to 16 mm.

12. A shoe-wiping mat according to claim 11, having a protrusion (Z) of the zig-zag boundary line in the direction of width of the base fabric, said protrusion is from 5 to 25 mm, and a pitch (Pz) in the lengthwise direction is from 20 to 80 mm.

* * * * *